US005338583A

United States Patent [19]

Hou

[11] Patent Number: 5,338,583

[45] **Date of Patent: * Aug. 16, 1994**

[54] DECORATIVE DISPLAY DEVICE

[75] Inventor: Jack Hou, Taipei, Taiwan

[73] Assignee: Giftec, Ltd., Alexandria, Va.

[ * ] Notice: The portion of the term of this patent subsequent to Aug. 11, 2010 has been disclaimed.

[21] Appl. No.: 104,636

[22] Filed: Aug. 11, 1993

Related U.S. Application Data

[63] Continuation-in-part of Ser. No. 805,657, Dec. 12, 1991, Pat. No. 5,286,535.

[51] Int. Cl.[5] ..... G09F 19/00

[52] U.S. Cl. ..... 428/7; 40/411

[58] Field of Search ..... 40/406, 410, 411; 428/11, 13, 7

[56] References Cited

U.S. PATENT DOCUMENTS

| | | | |
|---|---|---|---|
| 4,757,986 | 7/1988 | Hwang et al. | 428/13 X |
| 4,771,902 | 9/1988 | Teng | 428/13 X |
| 4,817,311 | 4/1989 | Ong | 428/13 X |
| 4,852,283 | 8/1989 | Teng | 428/13 X |
| 4,961,276 | 10/1990 | Lin | 428/11 X |
| 5,110,636 | 5/1992 | Hou | 428/11 |

*Primary Examiner*—Henry F. Epstein
*Attorney, Agent, or Firm*—Bacon & Thomas

[57] ABSTRACT

A display device wherein a decorative ornament is mounted on a drive plate that is driven by a windup music box drive mechanism through a transmission assembly so that rotation of the drive plate in a first direction winds up the drive mechanism which, during unwinding and the production of music, causes the drive plate and ornament to rotate in a second opposite direction.

7 Claims, 5 Drawing Sheets

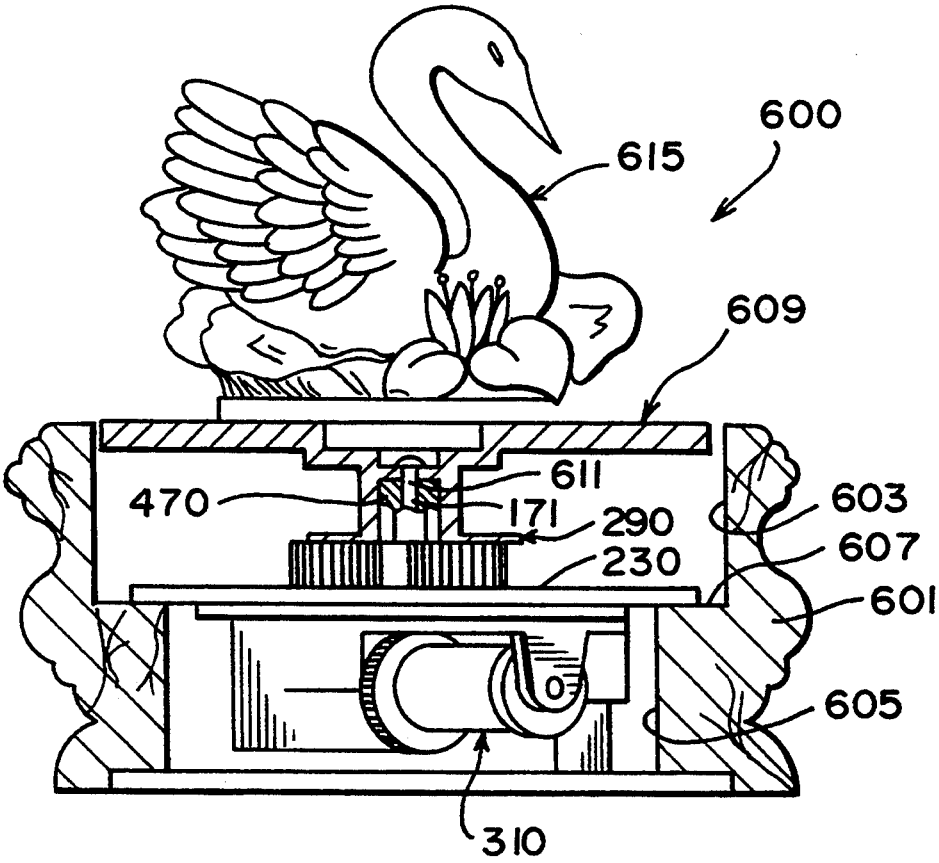
FIG. 6
FIG. 7
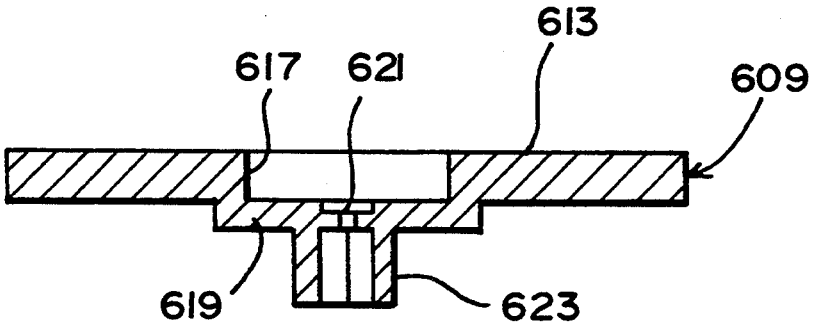

DECORATIVE DISPLAY DEVICE

CROSS REFERENCE TO RELATED APPLICATION

This application is a continuation-in-part of the Hou U.S. application Ser. No. 07/805,657, filed on Dec. 12, 1991, now U.S. Pat. No. 5,286,535.

BACKGROUND OF THE INVENTION

1. Field Of The Invention

The present invention generally involves the field of technology pertaining to devices for displaying ornamental objects, and more particularly to an improved liquid filled ball device for displaying objects immersed within the liquid.

2. Description Of The Prior Art

A decorative device in the form of a paper weight or similar novelty item wherein a transparent housing is sealed with decorative objects immersed in liquid and supported on a display base is well known. For example, the housing may contain a figure of a snowman and particles of white material simulating snow immersed within the liquid, so that manual agitation of the device by the user will cause a temporary suspending of the particles in the liquid. When the device is then placed on a support surface, the particles slowly settle on the figure and to the bottom of the housing, thereby simulating snow fall.

More sophisticated versions of these devices are also known wherein a drive motor is provided within the base of the device to create agitation of the liquid for imparting movement to objects immersed or suspended therein. These versions generally utilize an indirect magnetic drive for agitation of the liquid by disposing a first magnetic member in the liquid and positioning a second corresponding magnetic member out of the housing for rotation by the drive motor. Other forms of these devices may also include lighting means associated with the housing for illuminating the immersed objects and enhancing the ornamental display effect.

Display devices of the aforementioned types generally include a spherical housing formed of glass or transparent plastic material having a bottom opening defined by an outwardly extending neck portion which permits the housing to be filled with the required liquid and decorative objects. The bottom opening is sealed with a liquidtight gasket which may be frictionally or threadedly engaged around the neck portion. The sealed neck portion is then inserted within a base which supports the housing in a manner to permit viewing the decorative objects through the liquid from substantially all sides of the housing.

SUMMARY OF THE INVENTION

It is an object of the invention to provide an improved decorative display device.

It is another object of the invention to provide an improved display device wherein decorative objects are immersed in a liquid filled transparent spherical housing supported on a base.

It is a further object of the invention to provide a liquid filled display device for an ornamental object wherein movement is imparted to the object by a wind-up drive mechanism which also provides musical accompaniment.

It is yet also an object of the invention to provide an improved liquid filled display device which is simple in construction, economical to manufacture and reliable in operation.

These and other objects of the invention are realized by providing a display device that includes a transparent spherical housing having an outwardly extending neck portion which defines a bottom opening for filling the housing with an appropriate liquid. A cupshaped sealer provides a liquidtight seal for the bottom opening and includes a top surface for supporting an ornament in the liquid. The neck portion and sealer are inserted through a circular opening of a base and provided with a drive shaft which is drivingly connected to the power output shaft of a wind-up music box mechanism through a transmission assembly. The drive shaft and power output shaft are supported for rotation about parallel spaced axes, thereby permitting the utilization of a base having minimum dimensions that will accommodate a wind-up music box mechanism of conventional size and configuration.

Other objects, features and advantages of the invention shall become apparent from the following detailed description of preferred embodiments thereof, when taken in conjunction with the drawings wherein like reference numerals refer to corresponding parts in the several views.

BRIEF DESCRIPTION OF THE DRAWINGS

FIG. 6 is a front elevational view, partly in section, of the display device according to a third embodiment of the invention.

FIG. 7 is a cross-sectional view of a drive plate utilized in the third embodiment shown in FIG. 6.

DETAILED DESCRIPTION OF THE PREFERRED EMBODIMENTS

Figure 1:
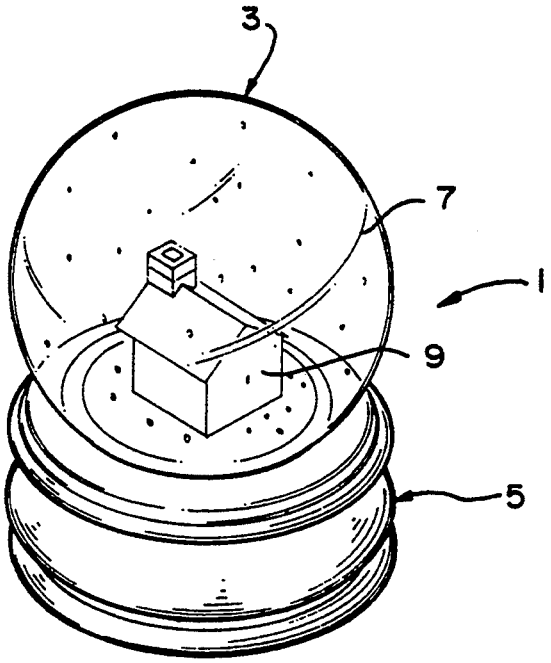
FIG. 1 is a perspective view of a display device according to a first preferred embodiment of the invention and shown in its assembled form.

A display device 1, according to a first preferred embodiment of the invention, shall now be described with initial reference to FIGS. 1 and 2. As shown therein, device 1 includes a spherical-shaped housing 3 supported on a substantially cylindrical-shaped base 5. Housing 3 may be formed of glass or other suitable transparent material, such as plastic, and is filled with an appropriate transparent liquid 7 within which an ornamental object 9 is immersed for display.

Figure 2:
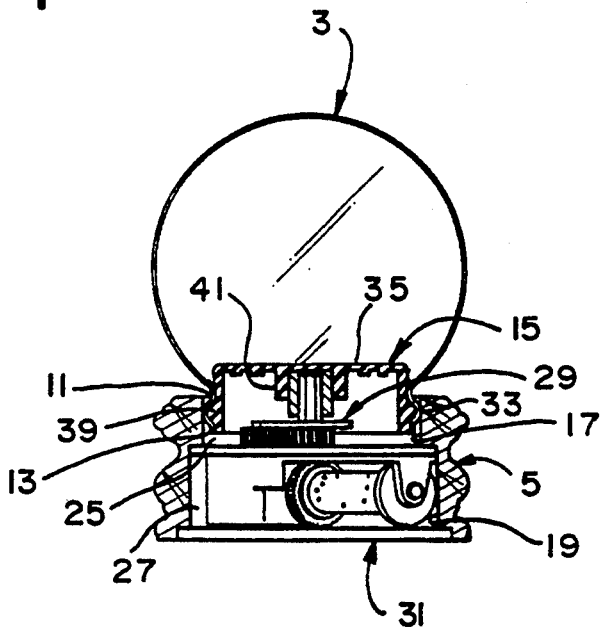
FIG. 2 is a front elevational view, partly in section, of the display device of FIG. 1, particularly showing the manner in which the housing is drivingly connected to the wind-up music box mechanism through the transmission assembly.

As seen in FIG. 2, housing 3 is provided with an outwardly extending circular neck portion 11 which defines a bottom opening 13 through which a cup-shaped sealer 15 is snugly received to form a liquidtight seal against the inner wall of neck portion 11. Base 5 is of substantially hollow construction and includes an interior defined by two cylindrical walls 17 and 19. The diameter of wall 17 is smaller than the diameter of wall 19, thereby defining a transverse annular wall 21 therebetween. A circular support plate 23 having a diameter corresponding substantially to that of wall 19 is positioned against annular wall 21, thereby dividing the interior of base 5 into an upper compartment 25 and a lower compartment 27, the vertical walls of which are formed by walls 17 and 19, respectively.

A transmission assembly 29 is disposed within upper compartment 25, and a conventional wind-up music box mechanism 31 is disposed within lower compartment 27. Transmission assembly 29 serves to drivingly connect sealer 1 5 to music box mechanism 31 and permits housing 3 to be rotated in opposite directions relative to base 5 in a manner to be hereinafter detailed.

Figure 3:
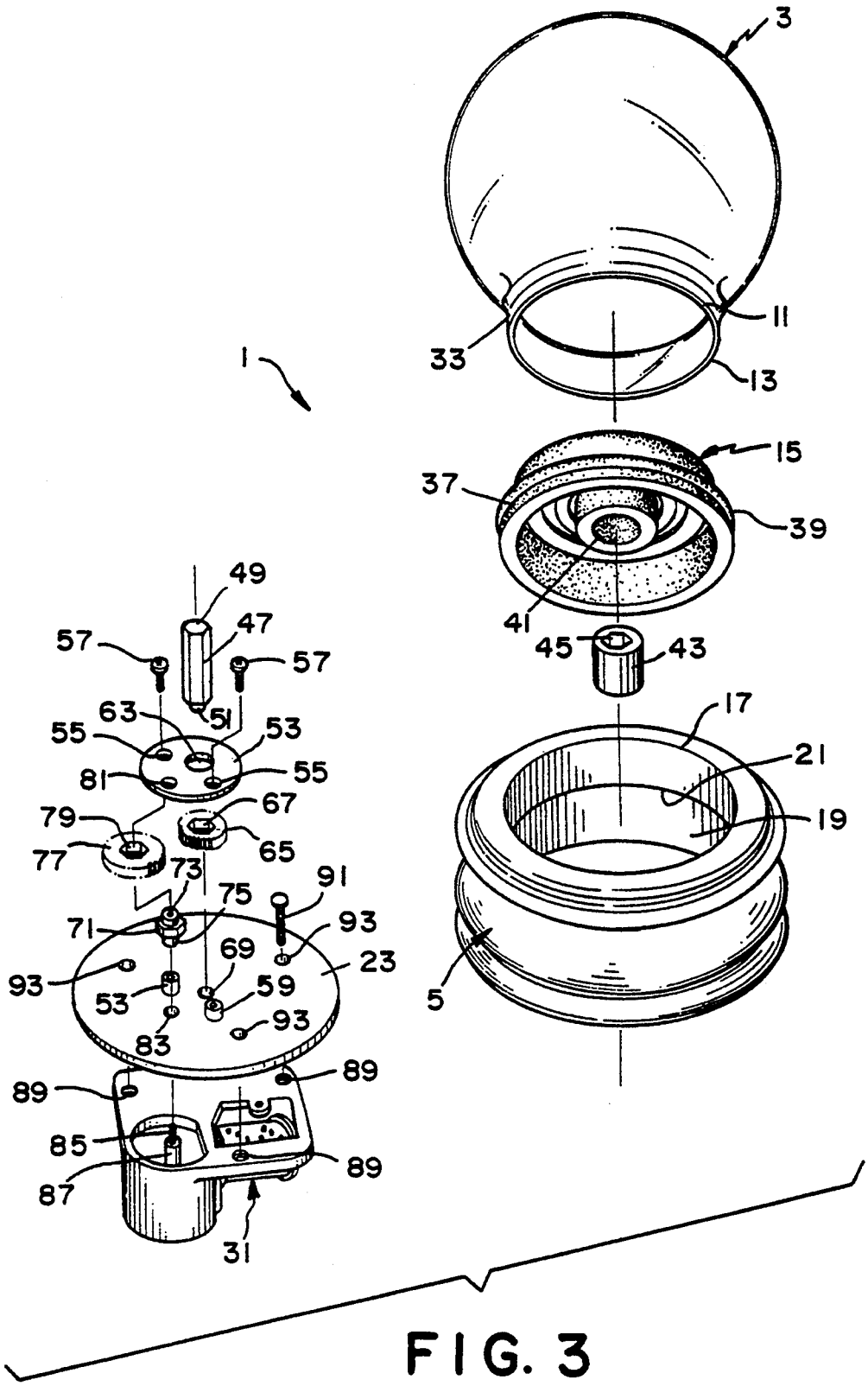
FIG. 3 is an exploded offset perspective view of the display device and particularly showing the individual components forming the device and the manner in which they are assembled together.

With reference to FIG. 3, neck portion 11 of housing 3 includes an outwardly extending annular groove 33 formed around its internal wall. Sealer 15 includes a substantially flat top surface 35 and a downwardly extending annular skirt 37 provided with an outwardly extending annular rib 39 around its outer periphery. Sealer 15 is appropriately sized in correspondence with the internal diameter of neck portion 11 so that it may be snugly and frictionally engaged therein to dispose rib 39 within groove 33, as shown in FIG. 2, to provide a secure liquidtight seal therebetween. When assembled in this manner, sealer 15 is tightly engaged with neck portion 11 to form an integral unit therewith so that rotation of housing 3 causes a corresponding rotation of sealer 15 and vice versa. Sealer 15 also includes a central downwardly extending hollow cylindrical member 41 within which a cylindrical drive socket 43 is frictionally engaged. Socket 43 includes an open-ended longitudinal passageway 45 having a preferably hexagonal transverse cross-section. As further seen in FIG. 2, when sealer 15 is fully engaged with neck portion 11, as previously described, the outer peripheral surface of neck portion 11, as extended by groove 33, has a slightly smaller diameter than that of wall 17 in order to permit free rotation of housing 3 relative to base 5. It is preferred that sealer 15 be integrally formed of a resilient material, such as rubber or other such appropriate material well known in the art for creating the liquidtight seal required for the practice of the invention as described herein.

As also seen in FIG. 3, there is provided a drive shaft 47 having a hexagonal transverse cross-section corresponding to that of passageway 45 of drive socket 43. Drive shaft 47 includes an upper end 49 which is inserted within passageway 45, and a lower end 51 of reduced diameter cylindrical configuration. Transmission assembly 29 includes both drive socket 43 and drive shaft 47. In addition, assembly 29 also includes a circular lock plate 53 provided with a pair of fastener apertures 55 formed therethrough for receiving a pair of corresponding threaded fasteners 57 which are used to secure plate 53 to support plate 23 by engaging a pair of corresponding threaded sockets 59 which extend outwardly from an upper surface 61 of plate 23. When fasteners 57 are threadedly engaged within sockets 59, plate 53 is secured to plate 23 in a parallel and spaced disposition from top surface 61. Plate 53 also includes a shaft aperture 63 having a diameter of sufficient size to permit drive shaft 47 to be inserted therethrough for attachment to a first circular gear wheel 65 positioned on the opposite side of plate 53. Gear wheel 65 is provided with a central hexagonal-shaped passageway 67 corresponding to the cross-section of shaft 47, thereby permitting shaft 47 and gear wheel 65 to be rotated together. Lower end 51 of shaft 47 is received within a corresponding cylindrical aperture 69 formed in plate 23.

Transmission assembly 29 further includes a nut 71 of preferably hexagonal cross-section. Extending outwardly from opposite sides of nut 71 are an upper threaded socket 73 and a lower threaded socket 75. A second gear wheel 77 having a central hexagonal aperture 79 therethrough corresponding to the hexagonal configuration of nut 71 is engaged on the latter with socket 73 and 75 extending outwardly from opposite sides of gear wheel 77. As apparent, nut 71 and gear wheel 77 are therefore engaged together for joint rotation. Upper socket 73 of nut 71 is rotatably received through a corresponding aperture 81 formed in lock plate 53 and may preferably be secured in place by engaging a threaded fastener (not shown) in socket 73. Likewise, bottom socket 75 is disposed through a corresponding aperture 83 formed in support plate 23 for threaded attachment to a threaded end 85 of a power output shaft 87 extending outwardly from music box mechanism 31.

Support plate 23 may be secured to annular wall 21 of base 5 in any appropriate manner, such as through the use of an adhesive or with mechanical fasteners, such as screws. Music box mechanism 31 is of conventional construction and typically provided with a plurality of threaded sockets 89 therearound for attaching mechanism 31 to plate 23. This may be accomplished by using a plurality of threaded fasteners 91 which are inserted through a plurality of corresponding apertures 93 formed through plate 23 and threadedly engaged within sockets 89.

In the assembled form of device 1 as shown in FIG. 2 and the exploded depiction of transmission 29 as shown in FIG. 3, it is apparent that drive shaft 47 of sealer 15 rotates with housing 3 about an axis of rotation that is coaxial with the central axes of neck portion 11 of housing 3, cylindrical member 41 of sealer 15, drive socket 43 and base 5. It is further apparent that through the use of lock plate 53 and the position of power output shaft 87 of music box mechanism 31, the axis of rotation of shaft 87 is offset or spaced from and parallel to the axis of rotation of shaft 47. The benefit of this arrangement is apparent because the configuration of conventional music box mechanism 31 positions power output shaft 87 adjacent a corner of mechanism 31, a situation which would otherwise require the utilization of a much larger base 5 if the axes of rotation of shafts 47 and 87 are disposed in coaxial alignment with each other. The invention therefore permits the utilization of a smaller structure for base 5, thereby providing the additional advantage of musical accompaniment to device 1 in an overall size which is comparable to that of a conventional display device without a music box mechanism.

As also apparent from FIGS. 1 and 2, sealer 15 includes a top surface 35 which is positioned within housing 3 and on which decorative object 9, or plural such objects 9, may be mounted or supported. In this way, rotation of housing 3 and associated sealer 15 imparts a corresponding movement to object 9.

The operation of display device 1 is accomplished by the user rotating housing 3 relative to base 5 in a first direction. By virtue of transmission assembly 29, rotation of drive shaft 47 imparts a corresponding rotation to power output shaft 87, thereby permitting mechanism 31 to be wound up in a conventional manner. Upon release of housing 3 and the placement of base 5 of device 1 on a support surface, mechanism 31 begins to automatically unwind, thereby rotating power output shaft 87 in an opposite direction and producing an appropriate preselected musical score. Simultaneously, rotation of shaft 87 is imparted through transmission assembly 29 to drive shaft 47, thereby rotating housing 3 in a second opposite direction. This imparts movement to object 9 and creates a moving visual display to musical accompaniment that is visually and aurally pleasing to the user.

Figure 4:
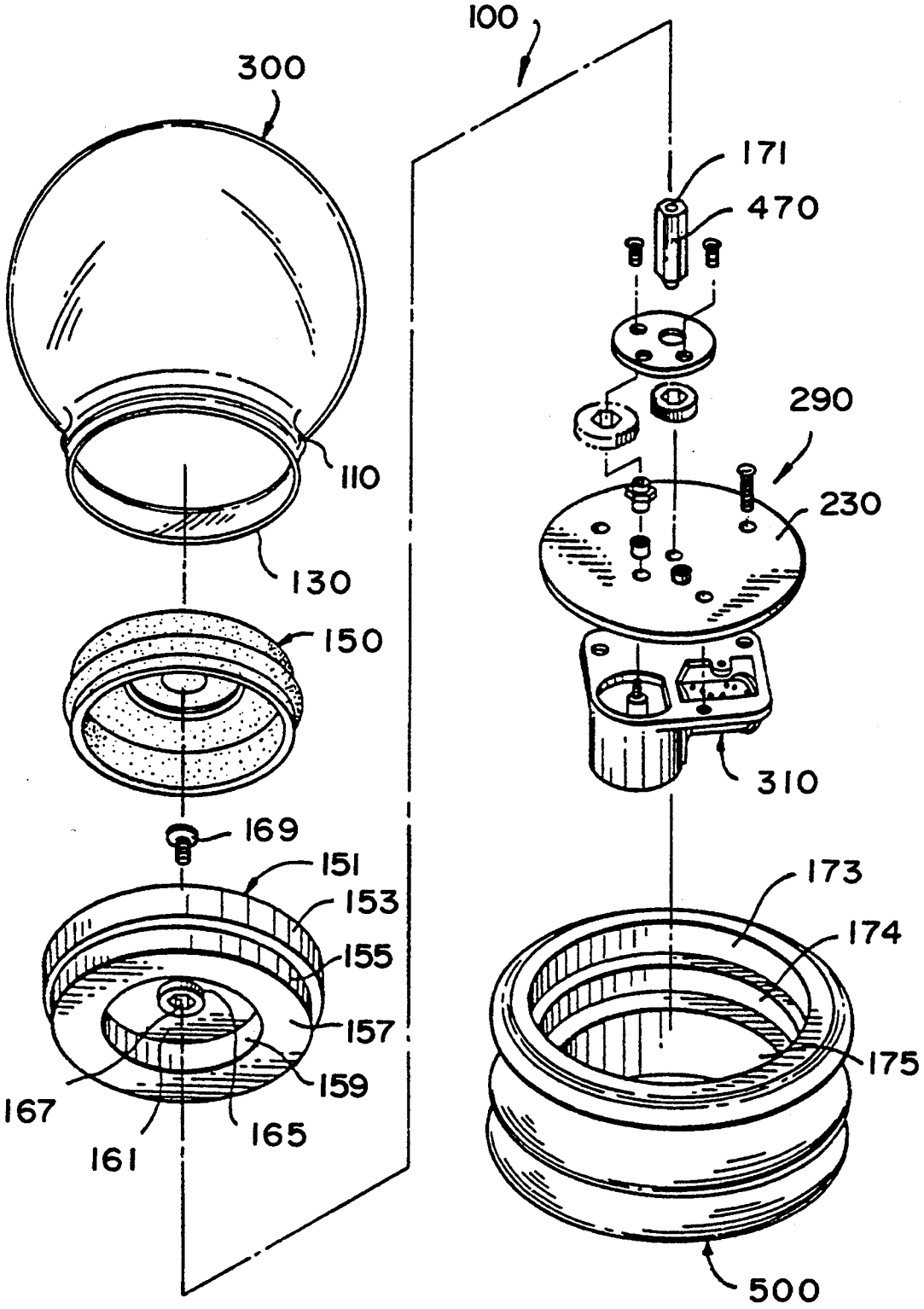
FIG. 4 is an exploded offset perspective view of the display device according to a second embodiment of the invention and particularly showing the individual components forming the device in the manner in which they are assembled together.

A display device 100, according to a second preferred embodiment of the invention shall now be described with reference to FIGS. 4 and 5. As shown therein, device 100 also includes a spherical-shaped housing 300 supported on a substantially cylindrical-shaped base 500. Housing 300 may also be formed of glass or other suitable transparent material. As in the case of the previous embodiment, housing 300 is also provided with an outwardly extending circular neck portion 1 10 which defines a bottom opening 130 through which a cup-shaped sealer 150 is snugly received to form a liquid-tight seal against the inner wall of neck portion 110. It shall be noted that sealer 150 does not include the central downwardly extending hollow cylindrical member 41 of the first embodiment, but is otherwise similar in configuration. Instead, there is provided a rigid drive cup 151 within which sealer 150 is received.

Drive cup 151 includes an upper sidewall portion 153 and a lower sidewall portion 155, with the diameter of the latter sidewall portion being less than the diameter of sidewall portion 153 to define a downwardly stepped configuration. Cup 151 also includes an annular bottom wall 157 which terminates radially inwardly at an inner cylindrical wall 159. The upper end of wall 159 terminates in a circular recessed wall 161 which is parallel to bottom wall 157. As shown, this configuration defines a substantially annular space 163 within cup 151. Recessed wall 161 of cup 151 is provided with a centrally positioned fixed cylindrical socket 165 having a downwardly directed recess 167 of preferably hexagonal cross section within which the upper end of a correspondingly configured drive shaft 470 is received and secured by means of a threaded fastener 169, the latter being engaged within a corresponding threaded aperture 171 formed in drive shaft 470. As is apparent, fixed socket 165 corresponds to drive socket 43 and drive shaft 470 corresponds to drive shaft 47 of the first embodiment.

Drive shaft 470 forms a part of a transmission assembly 290 which is otherwise exactly the same as transmission assembly 29 of the first embodiment. There is also provided a music box mechanism 310 which is also exactly the same as the corresponding mechanism 31 of the first embodiment.

Base 500 includes an inner cylindrical wall that is defined by three sequential wall sections 173, 174 and 175 of progressively decreasing diameter. As seen in FIG. 5, wall sections 173 and 174 correspond to wall portions 153 and 155 of drive cup 151 so that the latter may be received within base 500 and supported on the upper surface of a circular support plate 230 forming a part of transmission assembly 290. In this position, cup 151 is rotatable relative to base 500 and drive mechanism 310.

Figure 5:
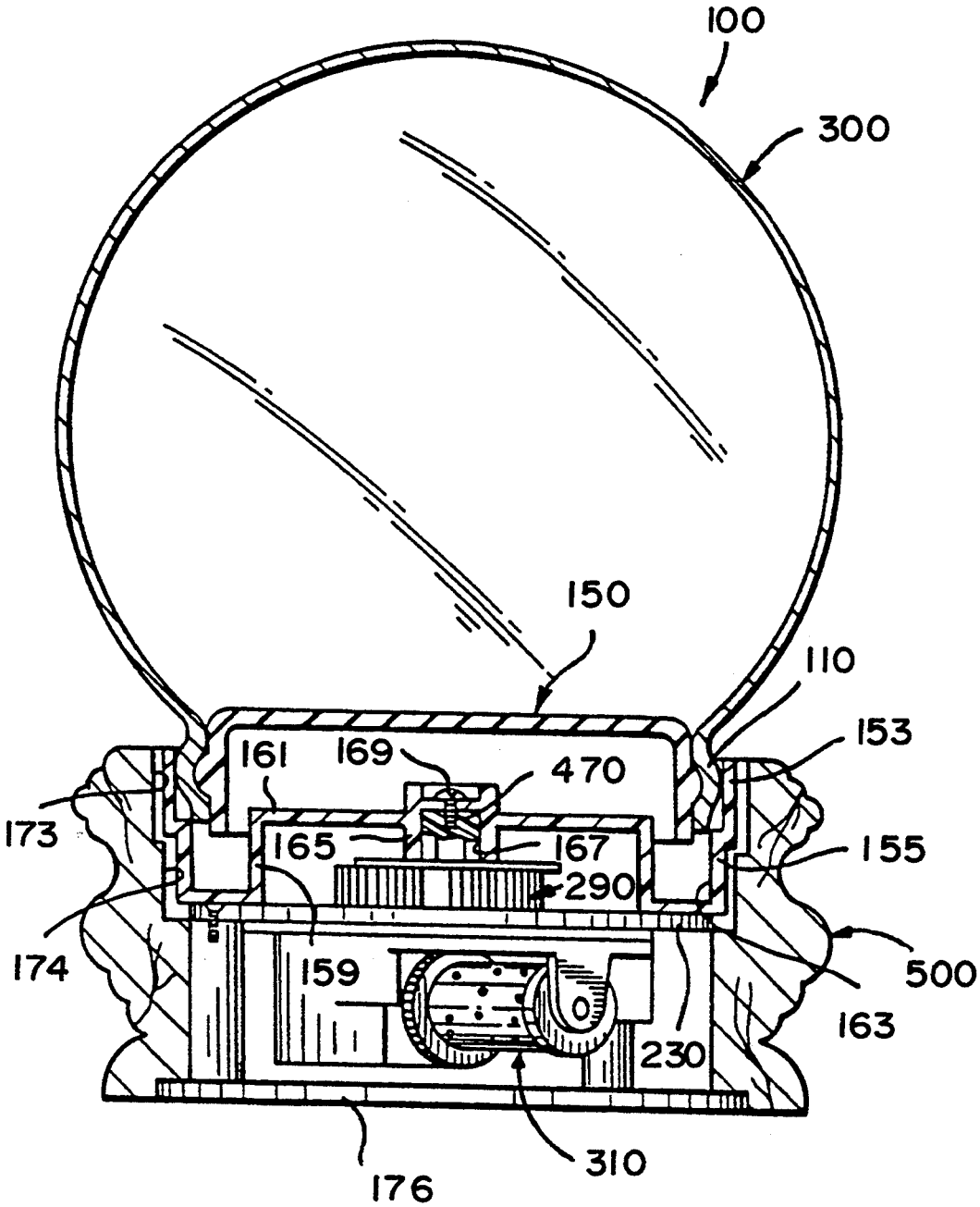
FIG. 5 is a front elevational view, partly in section, of the display device of FIG. 4, particularly showing the manner in which the housing is drivingly connected to the wind-up music box mechanism through the transmission assembly.

As particularly seen in FIG. 5, sealer 150 is tightly secured within bottom opening 130 of housing 300 in the same manner described for the first embodiment. Thereafter, circular neck portion 110 of housing 300 is disposed within drive cup 151 wherein the outer surface of neck portion 110 is snugly received within the inner cylindrical surface of wall portion 153 so that rotation of housing 300 causes a corresponding rotation of cup 151 in both the clockwise and counterclockwise directions. Since drive shaft 470 is secured within fixed socket 165 of cup 151, rotation of cup 151 also imparts a corresponding rotation to drive shaft 470, thereby permitting the winding and unwinding of music box mechanism 310 in exactly the same manner as previously described for the first embodiment.

It is preferable that drive cup 151 and its associated fixed socket 165 be integrally formed of a suitable rigid material, such as plastic or the like. Moreover, transmission assembly 290 and music box mechanism 310 may be secured within base 500 in any appropriate manner, such as through the use of a base plate 176 and suitable mechanical fasteners.

A display device 600, according to a third preferred embodiment of the invention, will now be described with initial reference to FIG. 6. As shown therein, device 600 includes a cylindrical base 601 that is similar in construction to base 500 of the second embodiment, with the exception that base 601 contains only two cylindrical wall sections 603 and 605. As apparent in FIG. 6, wall section 603 is of greater diameter than wall section 605 to define an annular ledge 607 therebetween.

There is also contained within base 601 circular support plate 230, transmission assembly 290 and wind-up music box mechanism 310, as found in and previously described for display device 100 of the second embodiment. In this case, support plate 230 is supported on annular ledge 607 of base 601. Similarly, device 600 is also provided with hexagonal drive shaft 470 which forms part of transmission assembly 290.

Display device 600 basically differs from display device 100 of the second embodiment in that device 600 is provided with a drive plate 609, preferably integrally molded of plastic material, which is coupled to drive shaft 470 by a mechanical fastener 611, such as a screw or the like, which is secured within threaded aperture 171 of shaft 470.

The details of drive plate 609 will now be described with further reference to FIG. 7. As seen therein, drive plate 609 includes an upper surface 613 on which an ornament 615 is mounted and secured in an appropriate manner, such as through the use of an adhesive or mechanical fastening means. Plate 609 is provided with a central recess 617 extending inwardly from upper surface 613 and preferably of cylindrical configuration. Recess 617 terminates at a bottom wall 619 provided with a central passage 621 therethrough. Passage 621 is coaxially aligned with a hexagonal socket 623 extending downwardly from bottom wall 619. As apparent, socket 623 is sized and configured for receiving hexagonal drive shaft 470 therein, with drive plate 609 being secured to drive shaft 470 by fastener 611 extending through passage 621 and into engagement with threaded aperture 171 of drive shaft 470.

As is therefore apparent, drive plate 609 is rigidly secured to drive shaft 470 and rotates therewith when rotational movement is imparted to drive shaft 470 through transmission assembly 290 by drive mechanism 310 in the same manner previously described for display device 100. Operation of device 600 may be accomplished by rotating drive plate 609 in a first direction to wind up drive mechanism 310 through transmission assembly 290. Upon release of drive plate 609, the unwinding of drive mechanism 310 causes drive plate 609 to rotate in an opposite direction and thus impart a corresponding movement to ornament 615. It is also possible to operate device 600 by utilizing a conventional wind up key (not shown) and activation switch (not shown) that are conventionally associated with music box drive mechanisms of the type described herein, so that the winding and activation operations may be realized from the bottom of device 600.

Though the invention has been disclosed in accordance with preferred embodiments thereof, it shall be understood that various changes in size, shape, composition and arrangement of parts may be resorted to by one skilled in the art without departing from the spirit of the invention or scope of the subjoined claims.

I claim:

1. A display device comprising:

a) a hollow base;

b) a drive mechanism and a drive shaft supported within the base, the drive shaft being drivingly connected to the drive mechanism;

c) a rotatable drive plate including an upper surface for supporting an ornament thereon, a bottom wall, a recess extending inwardly from the upper surface and terminating at the bottom wall, a socket extending downwardly from the bottom wall, and the drive shaft being engaged within the socket;

d) a fastening means disposed within the recess for securing the drive plate to the drive shaft; and e) whereby actuation of the drive mechanism causes the drive shaft to rotate the drive plate and impart a corresponding rotation to the ornament.

2. The display device of claim 1 wherein the socket and drive shaft are of corresponding hexagonal configurations.

3. The display device of claim 1 wherein the drive shaft further includes a threaded aperture, the bottom wall includes a central passage, and the fastening means includes a threaded fastener.

4. The display device of claim 1 wherein the drive plate is integrally formed of plastic.

5. The display device of claim 1 further including an ornament secured to the upper surface of the drive plate.

6. The display device of claim 1 further including a transmission assembly drivingly connecting the drive mechanism to the drive shaft.

7. The display device of claim 1 wherein the drive mechanism includes a windup music box.

* * * * *